United States Patent [19]

Player

[11] 4,155,206

[45] May 22, 1979

[54] INSULATED METAL ROOFING SYSTEM

[75] Inventor: Wayne H. Player, Mesquite, Tex.

[73] Assignee: Howmet Corporation, New York, N.Y.

[21] Appl. No.: 897,671

[22] Filed: Apr. 19, 1978

[51] Int. Cl.[2] ..... E04B 1/66; E04B 7/18

[52] U.S. Cl. ..... 52/200; 52/404; 52/478; 52/486; 52/489; 52/508; 52/522; 52/714

[58] Field of Search ..... 52/200, 478, 481, 484, 52/522, 536, 404, 407, 508, 762, 772, 486, 489, 714; 24/201 C; 248/317

[56] References Cited

U.S. PATENT DOCUMENTS

| | | | |
|---|---|---|---|
| 2,007,374 | 7/1935 | Kuehne | 52/407 X |
| 2,602,526 | 7/1952 | Day et al. | 52/404 X |
| 2,662,745 | 12/1953 | Jorn et al. | 52/762 X |
| 3,238,681 | 3/1966 | Vivio | 52/536 |
| 3,245,187 | 4/1966 | May | 52/478 |
| 3,289,375 | 12/1966 | Cline | 52/570 X |
| 3,304,680 | 2/1967 | Birdwell | 52/404 X |
| 3,479,784 | 11/1969 | Massagli | 52/309.11 X |
| 3,488,905 | 1/1970 | Campbell | 52/404 |
| 3,524,289 | 8/1970 | Yazejian | 52/522 X |
| 3,608,267 | 9/1971 | Curran | 52/588 X |
| 3,732,659 | 5/1973 | La Barge | 52/461 |
| 3,992,839 | 11/1976 | La Borde | 52/570 X |
| 4,038,799 | 8/1977 | Shanks | 52/404 X |
| 4,046,408 | 9/1977 | Ausnit | 24/201 C |

FOREIGN PATENT DOCUMENTS

| | | | |
|---|---|---|---|
| 284855 | 8/1968 | Australia | 52/588 |
| 252522 | 2/1967 | Austria | 52/761 |
| 99829 | 12/1964 | Denmark | 52/762 |
| 1509136 | 5/1969 | Fed. Rep. of Germany | 52/200 |
| 2149828 | 4/1972 | Fed. Rep. of Germany | 52/481 |
| 769526 | 2/1957 | United Kingdom | 52/543 |

*Primary Examiner*—Alfred C. Perham
*Attorney, Agent, or Firm*—Thomas L. Cantrell; Joseph H. Schley

[57] ABSTRACT

Disclosed is an insulated metal roofing system which includes channel shaped roofing panels locked together in side-by-side relationship at the upwardly projecting edges of the channel legs by means of interlocking flanges, with legs of adjacent panels in abutting relationship. In some embodiments specially configured clip members engage the roofing panels in their regions of abutment and project downwardly therefrom. Channel shaped ceiling panels are hung in side-by-side relationship on the clip members, and part or all of the space between the roofing panels and the ceiling panels is filled with insulation. The clip members are preferably constructed to provide a selection of points of connection between them and the ceiling panels to thereby provide a selection of spacings between the roofing panels and the ceiling panels. In another embodiment, the ceiling panels are connected directly to the roofing panels.

15 Claims, 8 Drawing Figures

INSULATED METAL ROOFING SYSTEM

BACKGROUND OF THE INVENTION

Add-on rooms, such as sun rooms, have become a popular means of economically increasing the livable space of houses which are otherwise of conventional construction. In order to hold down the cost of such rooms, it has become customary to use very lightweight and simple construction materials and methods. Some add-on rooms amount to little more than covered patios with sidewalls added. Generally speaking, the more rudimentary the construction of an add-on room, the lower its utility is, because such simply constructed rooms are not comfortable in very hot or moderately cold weather, and cannot be heated or cooled efficiently. Another limitation of such rooms, when they are constructed of metal panels, is that objectionable condensation tends to form on the interior ceiling and walls when the inside air is warm and humid and the outside temperature is cold.

Recently, energy shortages and cost increases have provided an additional incentive for increasing the weather-tightness and insulative quality of add-on rooms, which increases their all year round utility, but the pressure remains to hold down their cost by simple construction methods and materials. In some areas, the pressure to make add-on rooms energy efficient has occurred in the form of building code requirements, as well as economic pressure. In any event, there is an increasing need for constructional systems which preserve, to the extent possible, the cost advantages of lightweight add-on rooms, while making them substantially an energy efficient as conventional construction.

Certain Prior Art

As will be brought out fully hereinbelow, the present invention relates to a multi-part panel type insulated roof system which is particularly useful in add-on room construction, although the system is also useful in other building situations. Various composite or insulated metal roofing and siding systems are known in the art which bear some superficial resemblance to the system of the invention; e.g. U.S. Pat. Nos. 2,007,374; 3,304,680; 3,479,784; and 2,602,526; but none of these has the flexibility of application of the invention nor its particular utility in the add-on field. Other U.S. Pat. Nos. of general interest include: 2,739,677; 3,209,503; 3,228,162; 3,290,845; 3,347,010; 3,381,432; 3,397,496; 3,399,503, 3,455,070; 3,594,028 and 3,969,850.

SUMMARY OF THE INVENTION

In accordance with the present invention an insulated metal roofing system is provided which, in its preferred forms, involves four components which cooperate to provide an integrated roof and ceiling which is weather-tight, energy efficient, easily installed, and economical. The preferred systems thus include interlocking channel shaped roofing members, suspension clips attached to and depending from the roofing members, generally channel shaped ceiling members attached to the suspension clips and spaced below the roofing members, and insulative material interposed in the space between the roofing members and the ceiling members. In rooms of sufficiently small span, the suspension clips may be omitted and replaced by marginal ceiling support members, and such members may also be used to supplement the suspension clips in larger rooms. In one embodiment, the clips are omitted altogether, and the ceiling panels are connected directly to the roofing members.

The roofing members are generally channel shaped elongated panels, with the legs of the channels being upstanding and extending along the edges of the bases of the channels.

The roofing members are preferably formed of sheet metal, such as aluminum or steel, with the legs of the channel integral with the base. The upper margins of the channel legs are developed or formed into interlocking joint elements, preferably of the kind in which two panels are interlocked by rotating one panel with respect to the other. In their interlocked positions, adjacent panels have their upstanding legs in abutting relationship.

The upstanding legs of the roofing members are provided with detents for cooperation with the special suspension clips utilized in some embodiments of the invention, and with ceiling panels in another form of the invention, as is explained more fully hereinbelow.

In accordance with the invention, one of two forms of suspension clip is used to connect the ceiling panels to the roofing member. Both forms are preferably made of plastic such as polyvinyl chloride, which is strong and durable, yet a poor conductor of heat.

One form of clip is generally H-shaped in profile, with the bar of the "H" having a length substantially equal to the width of a roofing member. The upstanding legs of the "H" are adapted to fit between abutting upstanding channel legs of adjacent connected roofing members, and are provided with flanges along their top edges for engaging the abovementioned detents in the roofing member channel legs. When the clip is fully connected to a roofing member, the bar of the "H" lies along the underside of the roofing member. Because of the "springiness" of the H-shaped clip configuration when rendered in plastic, the bar of the "H" tends to urge the flanges of the upstanding legs more securely into the detents of the roofing member. In accordance with one variation of the H-shaped form of clip, the "springiness" of the clip is enhanced by configuring the bar of the "H" to include a vertical depending flange.

The depending legs of the H-shaped clip are provided with at least one set of outwardly and downwardly extending flanges which terminate in detents for forming connections with ceiling panels as is discussed below. Preferably the depending legs are provided with a plurality of sets of such flanges spaced at selected distances along the height of the legs. In this manner provision is made to selectively vary the spacing between roofing members and ceiling panels.

The other form of suspension clip which may be utilized in accordance with the invention is generally I-shaped in profile, with a flange or other connecting means at the top of the "I" for engaging the detent in a roofing member channel wall, and with at least one set of outwardly and downwardly extending flanges terminating in detents. Again, it is preferred that a plurality of such sets be provided so that the spacing between roofing members and ceiling panels may be selectively varied.

The ceiling panels of the invention are generally channel shaped elongated elements having a width substantially equal to the width of a roofing member, or if desired, some multiple of that width. The upstanding legs or sidewalls of the ceiling channels have flanges at their top edges for snap-locking engagement with detents on the suspension clips or alternately with the detents on the roofing panel.

The space between the roofing members and the ceiling panels is preferably filled with insulation, which may be in loose form, or in rolls or bats, or plastic slabs or other forms. It is less satisfactory, but the dead air space between the roofing members and the ceiling panels may itself be relied upon to provide some insulating effect.

Provision may be made for incorporating one or more skylights in the roofing system of the invention by utilizing special translucent roofing members and ceiling panels at selected points in place of the metal panels described above.

From the foregoing, it can be seen that a principal object of the present invention is the provision of an improved insulated metal roofing system which is simple in construction and installation, and flexible in arrangement.

The manner in which this object, together with other objects and purposes of the invention, are attained may best be understood from a consideration of the detailed description which follows, together with the accompanying drawings.

DESCRIPTION OF THE DRAWINGS

FIG. 6 is a side sectional elevational view of the roofing system of FIG. 3, the section being taken on the line 6—6 of FIG. 3;

DESCRIPTION OF THE PREFERRED EMBODIMENTS

Figure 1:
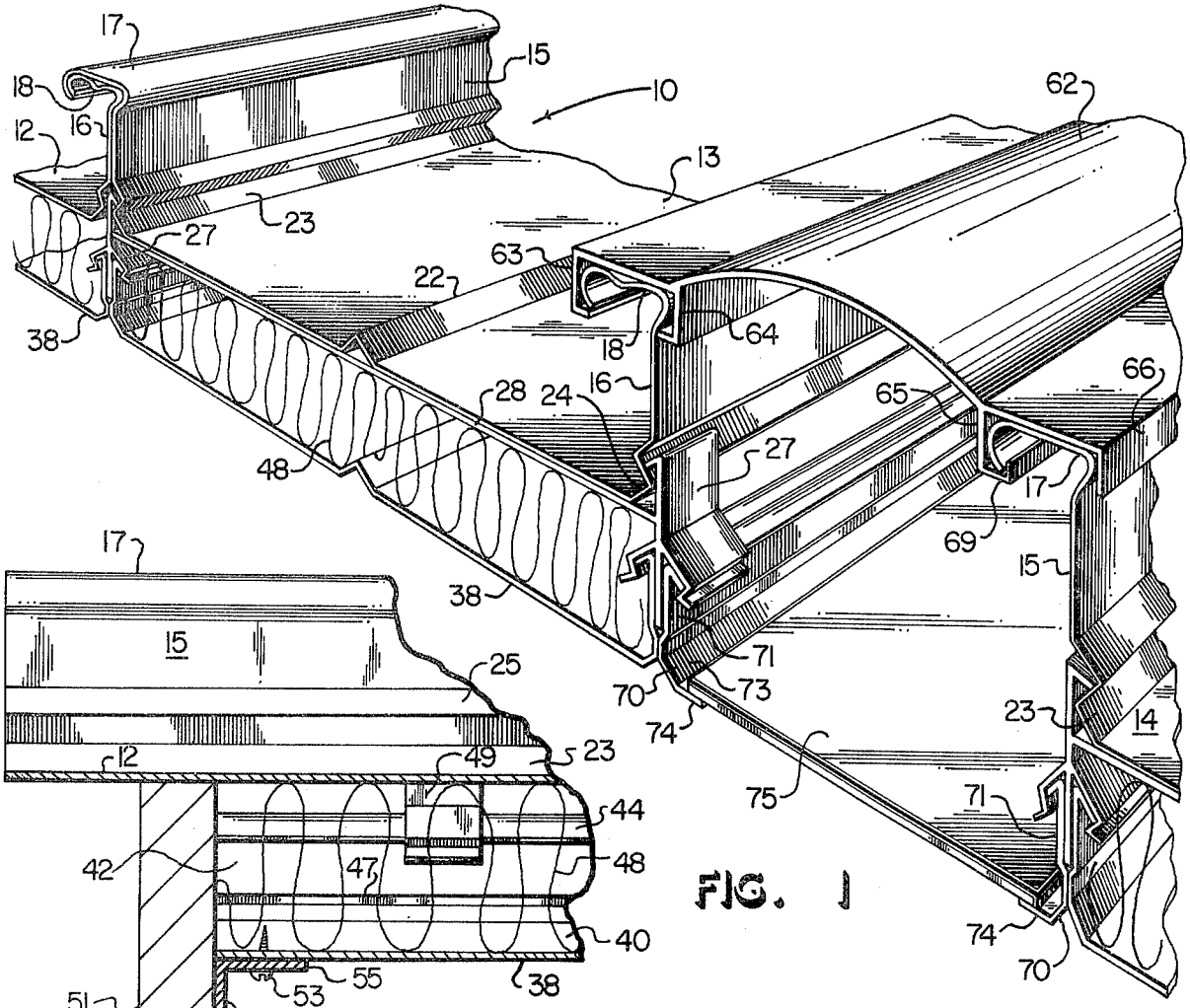
FIG. 1 is an end perspective view of an insulated metal roofing system constructed in accordance with the invention.
Figure 2:
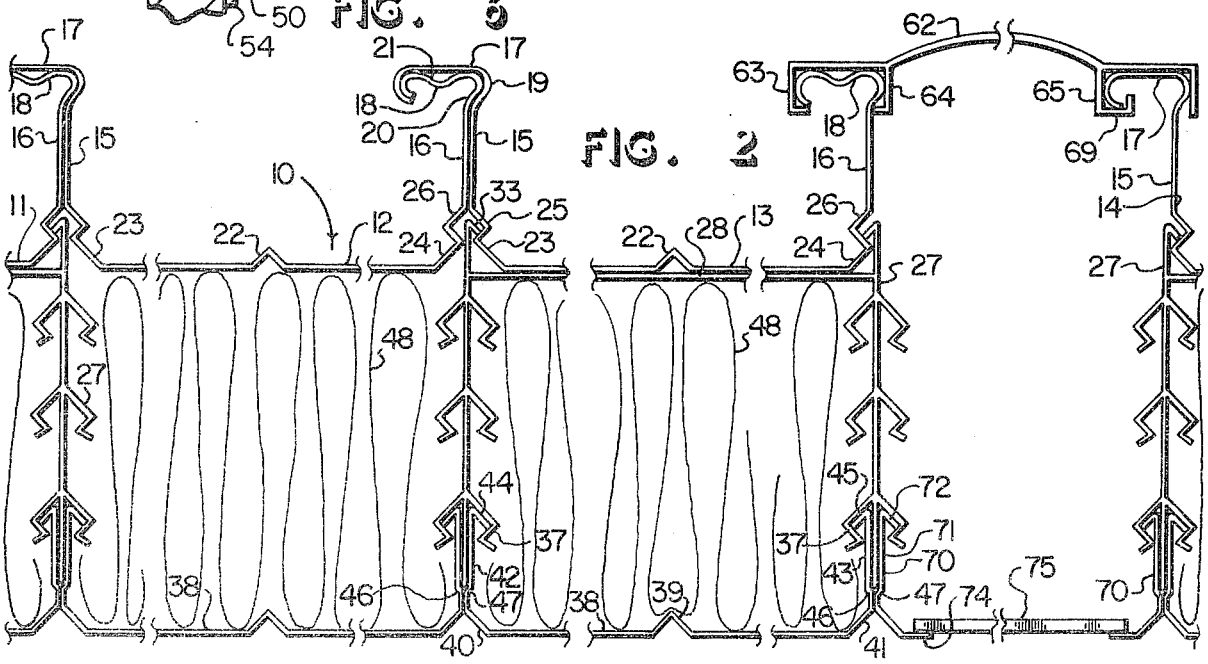
FIG. 2 is an end elevational view of an insulated metal roofing system much like that of FIG. 1, but with a thicker layer of insulation being provided.
Figure 3:
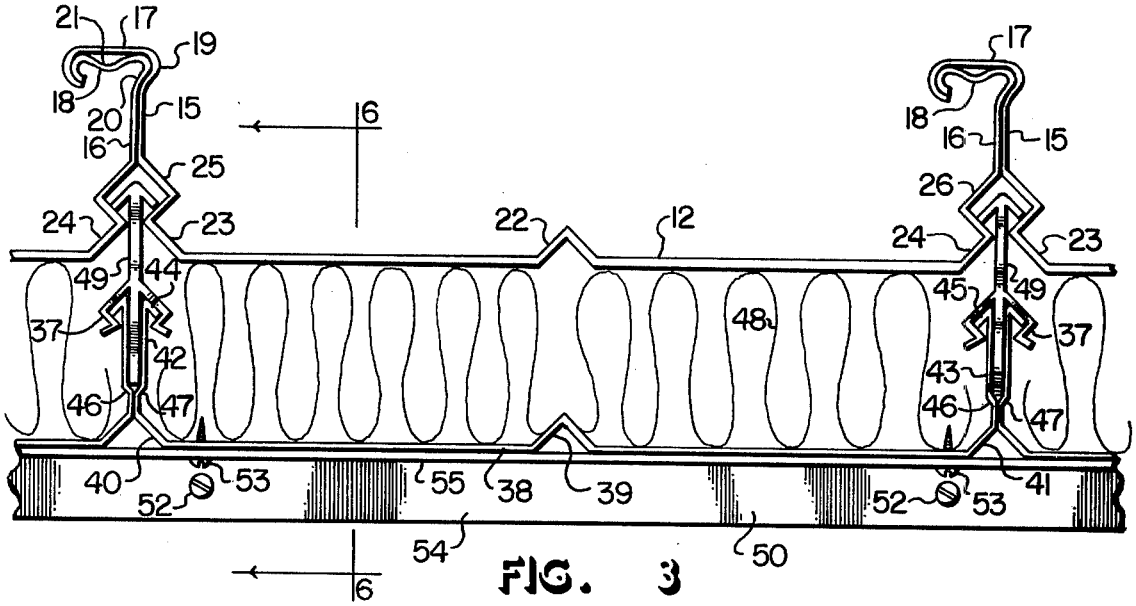
Figure 5:
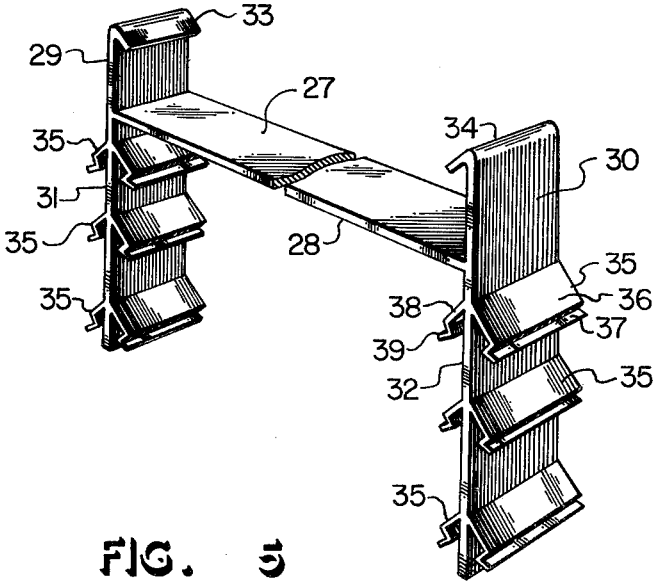
FIG. 5 is a perspective view of an H-shaped suspension clip constructed in accordance with the invention.

Attention is first directed to FIGS. 1, 2 and 5. As was mentioned above, the amount of insulation needed in an insulated roofing system varies from installation to installation, depending upon the part of the country in which the roof is being built, the desired degree of insulating efficiency, local building codes, and similar factors.

The roofing system illustrated in FIGS. 1 and 2 has this desired flexibility. FIG. 1 shows a roof with a modest amount of insulation therein, enough to retard moisture condensation on the ceiling, but not enough to prevent heavy heat loss in a severe climate. FIG. 2, by contrast, shows the same metal and plastic parts assembled into a roof with a very deep layer of insulation therein, enough to satisfy even a very demanding building code or owner's specification. The ability of the roofing system to accomodate different thicknesses of insulation is provided in large measure by the clip illustrated in FIG. 5.

In FIGS. 1 and 2, the roofing system of the invention is designated generally as 10. It includes a series of generally channel shaped roofing members 11, 12, 13, 14, arranged to lie parallel to each other in side-by-side relationship. (The skylight structure of FIGS. 1 and 2 is discussed herein below, and may be ignored for present purposes.) The roofing members are supported at their ends by the walls of the structure being roofed, or by suitable beams, neither of which are shown in FIGS. 1 and 2.

The roofing members 11–14 are each provided with upstanding walls or legs, the left-hand leg of each such panel being designated 15 and the right-hand leg 16. The upper edges of legs 15, 16 are developed into interlocking curled flanges 17, 18, respectively. By this means, adjacent panels may be locked together in side-by-side relationship with their upstanding legs 15, 16, in abutting relationship, and with curled flange 17 overlying and curling around curled flange 18. Flanges 17 and 18 of adjacent panels may best be interlocked together by rotating panel 13 with respect to already installed panel 12, for example. It should be noted that curled flange 17 has a detent 19 formed therein where it joins leg 15, which mates with similarly positioned detent 20 on curled flange 18. In addition, curled flange 18 has a depression 21 formed on its upper surface, which may accomodate a bead of caulking to insure watertightness of the joint.

If desired, the base of the channel of the roofing member may have one or more grooves 22 formed therein to provide longitudinal stiffening, and the junctions between the base of the channel and legs 15, 16, may be beveled, as at 23, 24.

Legs 15 and 16 have opposed detents 25, 26 formed therein near their junctions with the base of the channel of the roofing member. These are engaged by suspension clips 27.

The structure of clip 27 can best be understood from a consideration of FIG. 5. There it can be seen that the clip is generally H-shaped, having a bar 28, upstanding legs 29, 30, and depending legs 31, 32. The bar 28 has a length substantially equal to the width of a roofing member. Upstanding legs 29, 30 have inwardly and downwardly projecting flanges 33 and 34 formed at their top edges, for engagement with the detents 25, 26 in the roofing members.

The depending legs 31, 32 have three sets of ceiling panel engaging elements 35 formed thereon. Each set of ceiling panel engaging elements 35 comprises an outwardly and downwardly extending flange 36, terminating in a detent 37, and an opposed inwardly and downwardly extending flange 38, terminating in a detent 39.

Clip 27 is preferably formed of a resilient plastic material, such as polyvinyl chloride, which is a poor conductor of heat. As can be seen from FIG. 5, the clip is relatively short or narrow, although it may have any desired length, even being coextensive in length with the ceiling member, if desired. Preferably, for economy of material, short clips are employed, and are spaced along a roofing member at intervals of several feet.

As can be seen from FIGS. 1 and 2, the suspension clip 27 is connected to a roofing member, such as 13, with flanges 33, 34, snap-locked into detents 25, 26. The bar 28 of the clip lies along the underside of the roofing member, and assists in maintaining the parts in connected position by reason of the springiness of the material.

Figure 7:
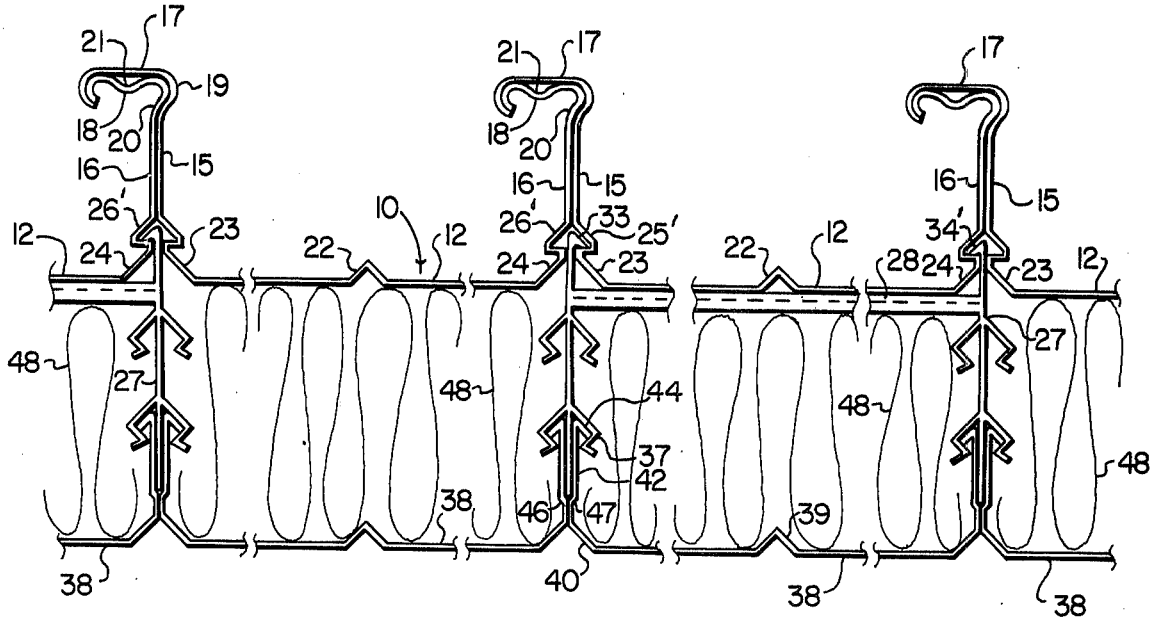
FIG. 7 is an end elevational view of an insulated metal roofing system much like that of FIGS. 1 and 2, but having an intermediate thickness of insulation, utilizing a modified form of H-shaped clip, and further utilizing a modified form of detent in the ceiling panels.

If it is desired to have a maximum spacing (and a maximum thickness of insulation) between the roofing members and the ceiling panels, the suspension clip 27 is installed in the configuration shown in FIG. 5. But if a closer spacing is needed, one or two sets of ceiling panel engaging elements are cut off each depending leg of the clip. Thus, in the embodiment shown in FIG. 1, the clip has been foreshortened so that the uppermost set of ceiling panel engaging elements is the one employed to engage the ceiling panel. In the embodiment of FIG. 7, one set of ceiling panel engaging elements has been cut off the clip to provide an intermediate thickness of insulation.

The ceiling panels of the invention are generally channel shaped elongated metal elements designated 38 in the drawings. The base of the channel may have a groove 39 formed therein for longitudinal stiffening, and the junctions of the legs and base of the channel may be beveled, as at 40, 41. The grooves and bevels also provide a decorative effect on the underside of the ceiling. The legs or sidewalls of the channel are designated 42, 43, and are provided with downwardly and inwardly extending flanges 44, 45 along their top edges for snap-locked engagement with detents 37 of the clip 27. It should be noted that the legs 42, 43 are each offset inwardly a small amount a short distance above the junction bevels 40, 41 as at 46, 47 so that when two ceiling panels are placed in abutting relationship, there is formed between them a narrow upwardly open slot in which the end portion of depending leg 31 or 32 of suspension clip 27 fits.

A layer of insulation (indicated very diagrammatically at 48) is installed between the ceiling panels and the roofing members. Desirably, substantially the entire space is so filled, but it need not be.

The roofing system illustrated in FIGS. 1 and 2 may be easily installed at the construction site, using a basic one-panel-at-a-time approach. A worker installs roofing panels from left to right as FIGS. 1 and 2 are drawn, pivoting each succeeding panel around the curled flange of its already installed neighbor to the left to interlock them together in abutting relationship. The H-shaped clips are preferably installed on every other roofing panel prior to pivoting it into place. The ceiling panels are then snapped onto the clips from below, from left to right, either one at a time or in small groups. The insulation may be installed in each ceiling panel just prior to putting the panel in place, or it may be installed earlier, even at the factory.

Figure 3:
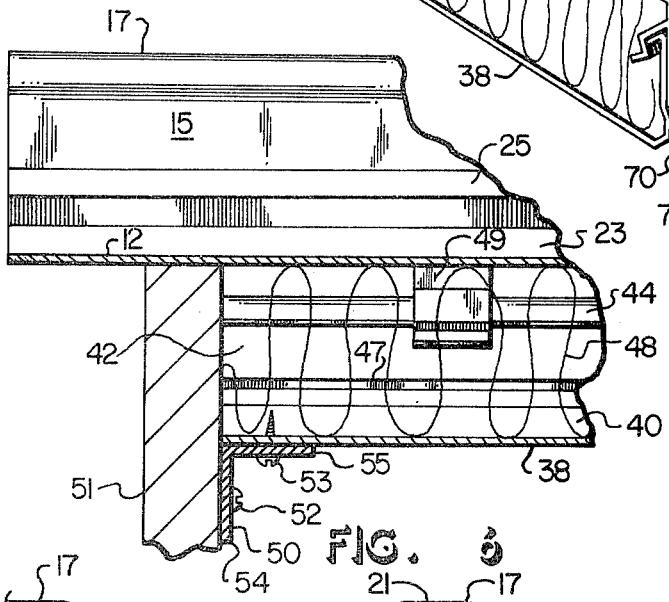
FIG. 3 is an end elevational view of another embodiment of the roofing system of the invention, utilizing a different form of suspension clip.

In the embodiment illustrated in FIGS. 3 and 6, the roofing members, ceiling panels and insulation all have basically the same structure and mode of operation, and the parts are therefore given the same reference characters as were employed in connection with FIGS. 1 and 2. Reference is made to the foregoing discussion for an understanding of these parts. The clip employed in the embodiment of FIGS. 3 and 6 differs from that employed in the embodiment of FIGS. 1 and 2 in that it is I-shaped rather than H-shaped, and is desirably installed after a pair of roofing panels are locked together rather than before. In FIGS. 3 and 6, the I-shaped clips are designated 49. The structure of clips 49 is substantially like that of upstanding leg 30 and depending leg 32 of clip 27 shown in FIG. 5. Clips 49 engage the roofing members and ceiling panels in substantially the same manner as clips 27.

FIGS. 3 and 6 also show an L-shaped perimeter support member 50, which is attached to room side wall 51 by screws 52, and to the underside of the ceiling panels by screws 53. Support member 49 thus has its vertical leg 54 in abuttment with the room wall, while its horizontal leg 55 is cantilevered outwardly to provide support to the ceiling panels. In rooms of sufficiently small span, perimeter support members alone may be adequate to support the ceiling panels, and the clips may be omitted.

Figure 4:
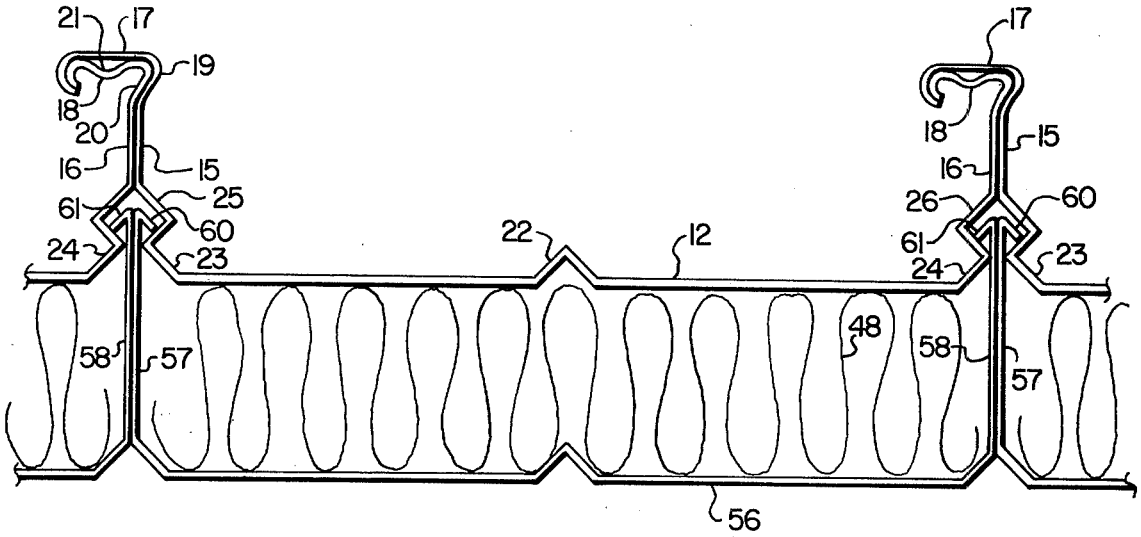
FIG. 4 is an end elevational view of still another embodiment of the invention, in which the suspension clips are omitted and the ceiling members are connected directly to the roofing members.

In the modified embodiment of the invention shown in FIG. 4, the roofing members and the insulation have substantially the same structure as in the embodiment of FIGS. 1–3, and are therefore given the same reference characters. The ceiling panels 56 of FIG. 4 differ from ceiling panels 38 in other embodiments in that their upwardly extending legs 57, 58 are relatively longer, so that they may be detent locked directly to the roofing members at the detents formed therein. To that end, legs 57, 58, have downwardly and inwardly projecting flanges 60, 61, formed at their upper edges. It should be noted that the embodiment of FIG. 4 has the advantage of requiring fewer parts than the other embodiments, but there is some metal-to-metal contact between the ceiling panel and the roofing members.

Attention is redirected to FIGS. 1 and 2 which illustrate the features of the invention that make it possible to include a skylight in the roofing system quite readily. At the location where a skylight is desired, a roofing member 13 is omitted from the side-by-side series of such members, and is replaced by a translucent skylight roofing member 62, preferably formed of polyvinyl chloride resin, or some other suitable translucent or transparent material. Translucent member 62 is provided with a first pair of downwardly extending flanges 63, 64, for engaging curled flange 18, and a second pair of downwardly extending flanges 65, 66, for engaging curled flange 17. Flange 63 has an inwardly turned detent lip 67, and flange 64 has an outwardly turned detent lip 68, for snap-lock engagement with curled flange 18. Similarly, flange 65 has an outwardly and upwardly turned detent lip 69 for locking engagement with curled flange 17. Preferably skylight roofing member 62 is arched in profile to enhance its stiffness.

At ceiling level, the skylight structure includes support strips 70. These strips have substantially the same profile as the edge portions of the ceiling panels. Thus each strip has a vertical leg 71 which terminates in a downturned flange 72 for detent locking with a clip 27; and bevel section 73; and a horizontal leg 74. A translucent or transparent panel 75 is supported by the legs 74, and may be readily removed, if desired, by tilting it to work it past legs 74.

Figure 8:
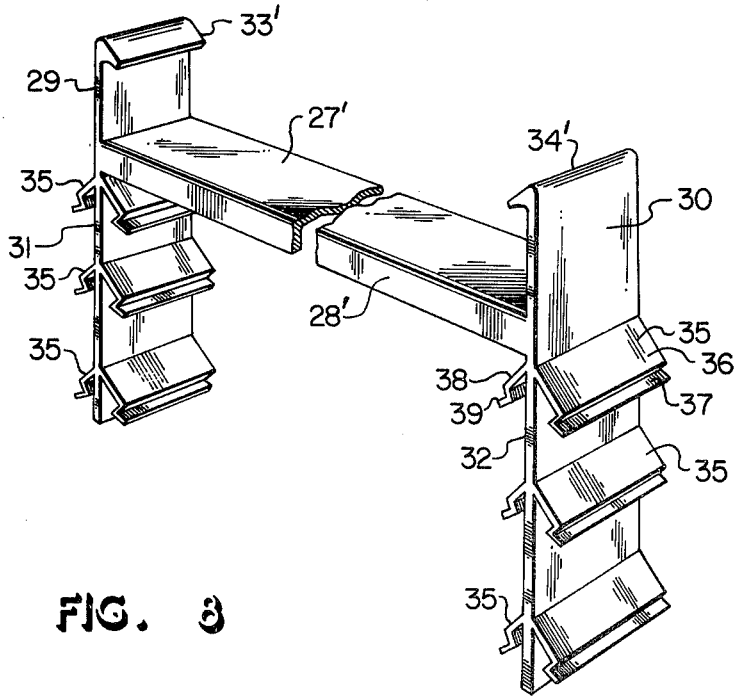
FIG. 8 is a perspective view of the clip utilized in the embodiment of FIG. 7.

Attention is now directed to FIGS. 7 and 8, which show a roofing system modified in certain respects from those discussed above. Unchanged parts and features are given the same reference characters, while modified parts are given equivalent characters with primes added. In this embodiment detents 25′, 26′ have flattened bottoms to enhance the detent locking effect. Flanges 33′, 34′ of clip 27′ are somewhat thickened to correspond with the altered shape of the detent. In addition bar 28′ of clip 27′ has a downturned lip or flange to increase its stiffness and thus the springiness of the clip.

I claim:

1. An insulatable metal roofing structure comprising:

channel shaped roofing members having upstanding side legs with interlockable flanges formed at their upper ends for interlocking a series of said panels together in side-by-side relationship;

said roofing members being of selected substantially uniform width;

said roofing member legs having outwardly facing detent grooves formed therein and positioned to establish a tube-like detent space between adjacent interlocked roofing members;

channel shaped ceiling panels having upstanding side legs, said panels being of a width such that the legs of a ceiling panel are substantially alignable with legs of superjacent roofing members;

and ceiling panel suspension means including an element penetrating between legs of adjacent interlocked roofing members from below to detent lock in said detent space to thereby suspend said ceiling panels a selected distance beneath said roofing members, whereby a volume for accommodating insulation above the ceiling and beneath the roof is established.

2. A roofing structure in accordance with claim 1 in which said ceiling panels have a width substantially equal to the width of a roofing member, thereby establishing said alignability of ceiling panel legs with roofing panel legs on a one-panel-for-one-member basis.

3. A roofing structure in accordance with claim 1 in which said ceiling panel suspension means comprise downturned detent flanges on the legs of said ceiling panels detent lockable in said detent space.

4. A roofing structure in accordance with claim 1 in which said ceiling panel suspension means comprise clip members having detent locking means thereon for penetrating between legs of adjacent interlocked roofing members to detent lock in said detent space, and further having means engaging the upturned legs of a ceiling panel.

5. A roofing structure in accordance with claim 4 in which said clip members are formed of insulative material.

6. A roofing structure in accordance with claim 4 in which said clip members are provided with a plurality of vertically spaced ceiling panel leg engaging means, thereby enabling the distance between roofing members and ceiling panels to be selectively established during the course of installation of said roofing structure.

7. A roofing structure in accordance with claim 4 in which said ceiling panel leg engaging means comprise outwardly extending detent flanges.

8. A roofing structure in accordance with claim 4 in which said clip members are substantially H-shaped in profile, the bar of said "H" having a width sufficient to span the underside of a roofing member, the upstanding legs of said "H" having said detent locking means thereon, and the depending legs of said "H" having said ceiling panel leg engaging means thereon.

9. A roofing structure in accordance with claim 4 in which said clip members are substantially I-shaped in profile, the upper portion of said "I" having said detent locking means thereon, and the lower portion of said "I" having said ceiling panel leg engaging means thereon.

10. A roofing structure in accordance with claim 1 and further comprising skylight means comprising:

an elongated skylight roofing panel formed of light transmitting material and having detent locking means formed along the longitudinal edges thereof for engagement with the interlocking flanges on the legs of said roofing members;

a pair of elongated skylight ceiling panel support elements each engaging one of said ceiling panel suspension means, said support elements each having a horizontally projecting flange;

and a substantially planar skylight ceiling panel formed of light transmitting material supported on said horizontally projecting flanges along opposed edges of said skylight ceiling panel.

11. An insulatable metal roofing structure comprising:

channel shaped roofing members having upstanding side legs with interlockable flanges formed at their upper ends for interlocking a series of said panels together in side-by-side relationship;

said roofing members being of selected substantially uniform width;

said roofing member legs having outwardly facing attachment means formed therein;

channel shaped ceiling panels having upstanding side legs, said panels being of a width such that the legs of a ceiling panel are substantially alignable with legs of superjacent roofing members;

and ceiling panel suspension means including an element penetrating between legs of adjacent interlocked roofing members from below to engage said attachment means to thereby suspend said ceiling panels a selected distance beneath said roofing members, whereby a volume for accomodating insulation above the ceiling and beneath the roof is established.

12. A roofing structure in accordance with claim 11 in which said ceiling panels have a width substantially equal to the width of a roofing member, thereby establishing said alignability of ceiling panel legs with roofing panel legs on a one-panel-for-one-member basis.

13. A roofing structure in accordance with claim 11 in which said ceiling panel suspension means comprise clip members having detent locking means thereon for penetrating between legs of adjacent interlocked roofing members to detent lock with said attachment means, and further having means engaging the upturned legs of a ceiling panel.

14. A roofing structure in accordance with claim 13 in which said clip members are formed of insulative material.

15. A roofing structure in accordance with claim 11 and further comprising skylight means comprising:

an elongated skylight roofing panel formed of light transmitting material and having detent locking means formed along the longitudinal edges thereof for engagement with the interlocking flanges on the legs of said roofing members;

a pair of elongated skylight ceiling panel support elements each engaging one of said ceiling panel suspension means, said support elements each having a horizontally projecting flange;

and a substantially planar skylight ceiling panel formed of light transmitting material supported on said horizontally projecting flanges along opposed edges of said skylight ceiling panel.

* * * * *